US008943781B2

(12) United States Patent
Phillips

(10) Patent No.: US 8,943,781 B2
(45) Date of Patent: Feb. 3, 2015

(54) STORAGE DEVICE FOR ELONGATED ARTICLES

(71) Applicant: Brandyn B. Phillips, Eden Prairie, MN (US)

(72) Inventor: Brandyn B. Phillips, Eden Prairie, MN (US)

(73) Assignee: All Holiday Solutions, L.L.C., Eden Prairie, MN (US)

( * ) Notice: Subject to any disclaimer, the term of this patent is extended or adjusted under 35 U.S.C. 154(b) by 0 days.

(21) Appl. No.: 13/894,368

(22) Filed: May 14, 2013

(65) Prior Publication Data

US 2013/0247522 A1 Sep. 26, 2013

Related U.S. Application Data

(63) Continuation of application No. 11/993,920, filed as application No. PCT/US2006/024879 on Jun. 26, 2006, now Pat. No. 8,443,579.

(60) Provisional application No. 60/694,454, filed on Jun. 27, 2005.

(51) Int. Cl.

| | |
|---|---|
| ***B65D 8/14*** | (2006.01) |
| ***B65B 5/04*** | (2006.01) |
| ***B65D 85/42*** | (2006.01) |
| ***B65H 75/36*** | (2006.01) |
| *B65D 8/02* | (2006.01) |

(52) U.S. Cl.

CPC ..... *B65B 5/045* (2013.01); *B65D 85/42* (2013.01); *B65H 75/36* (2013.01); *B65D 2585/86* (2013.01); *B65H 2701/3915* (2013.01)

USPC ..... 53/399; 53/567; 53/413; 220/8

(58) Field of Classification Search

CPC ..... B65B 9/15; B65B 9/13; B65B 39/007; F21S 4/001; B65H 2701/3915; F21V 27/00; F21V 15/00; B65D 77/044; B65D 77/0473; A45C 11/16; A47F 7/02

USPC ..... 220/8, 495.01, 629, 669, 752; 221/198, 221/255, 279; 206/6.1, 388; 53/399, 413

See application file for complete search history.

(56) References Cited

U.S. PATENT DOCUMENTS

| | | | | | |
|---|---|---|---|---|---|
| 2,865,157 | A * | 12/1958 | Talsma | 53/261 |
| 4,987,724 | A * | 1/1991 | Rutherford | 53/399 |
| 5,293,501 | A * | 3/1994 | Bennett et al. | 174/135 |
| 5,971,612 | A * | 10/1999 | McAuslan | 383/43 |
| 6,009,688 | A * | 1/2000 | Pedersen et al. | 53/399 |
| 6,189,744 | B1 * | 2/2001 | Prince | 222/386.5 |
| 6,237,769 | B1 * | 5/2001 | Collom | 206/419 |
| 7,966,792 | B1 * | 6/2011 | Hills | 53/567 |
| 8,443,579 | B2 * | 5/2013 | Phillips | 53/399 |

* cited by examiner

*Primary Examiner* — Mickey Yu
*Assistant Examiner* — Niki Eloshway
(74) *Attorney, Agent, or Firm* — Thomas J. Oppold; Larkin Hoffman Daly & Lindgren, Ltd.

(57) ABSTRACT

An apparatus and method for storing an elongated article, such as a light string or the like. The apparatus includes a hollow tube and an elongated sock. The elongated sock is fed onto the hollow tube such that end of said sock is in proximity to the end of the tube. In use, one end of the elongated article is inserted through the hollow tube and is pulled through the tube along with the sock. As the length of the elongated article is pulled through the tube along with the sock, the length of the elongated article is disposed within the length of the sock.

4 Claims, 1 Drawing Sheet

STORAGE DEVICE FOR ELONGATED ARTICLES

CROSS-REFERENCE TO RELATED APPLICATIONS

This is a continuation of U.S. application Ser. No. 11/993,920 filed Dec. 26, 2007 which is a U.S. national stage application of International Application No. PCT/US2006/024,879 filed Jun. 26, 2006 which claims priority to U.S. Provisional Application No. 60/694,454 filed Jun. 27, 2005.

BACKGROUND

Holiday string lights such as Christmas tree and house ornament lights are often stored loosely in a storage box or on a shelf. Inevitably, the individual lights and electrical cord comprising the string become entangled or intertwined resulting in a tangled mass, which, every season, the homeowner must untangle. Also, inevitably, lights stored in such a manner will become broken during storage or out of frustration trying to untangle the tangled heap the next season. Accordingly, there is a need for a low cost, easy to use device that enables homeowners to store their string lights in manner that prevents tangling and protects the lights from damage.

SUMMARY OF THE INVENTION

The present invention is directed toward a device for storing elongated articles such as light strings and the like. The device includes a length of hollow tube and an elongated sock having an open end and, preferably, a closed end. The length of the elongated sock is preferably substantially the same or longer than the length of the light string to be stored.

In use, the open end of the sock is placed over one end of the hollow tube and is bunched up onto the tube until the preferred closed end of the sock approaches the end of the tube. One end of the light string is inserted through the open end of the tube received within the sock. The light string is fed into the tube until its end reaches the preferred closed end of the sock. Holding the tube in one hand, a user then simply grasps with the other hand the end of the light string within the sock and pulls the sock together with the light string in the direction away from the tube. As the light string and sock are pulled together, the sock is pulled off the tube as the light string is pulled through the tube, resulting in the length of the light string disposed within the length of the sock. The sock with the light string disposed therein can then be coiled around the tube or simply coiled and placed in a box or on the shelf. The lights are protected by the sock and the individual lights and cord are prevented from becoming entangled or intertwined. When it is desired to reuse the light string, the free end of the light string is simply pulled from the open end of the sock.

DESCRIPTION OF THE INVENTION

Figure 1:
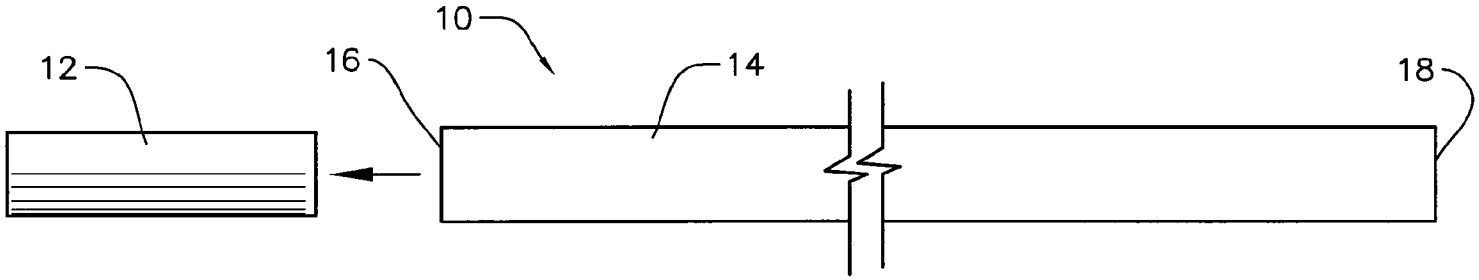
FIG. 1 illustrates one embodiment of the present invention wherein the open end of the sock is being placed over one end of the hollow tube.

Referring to the drawings wherein like reference numerals designate identical or corresponding parts or features throughout the several drawing figures, FIG. 1 illustrates one embodiment of the elongated article storage device of the present invention designated generally by reference numeral 10.

Figure 2:
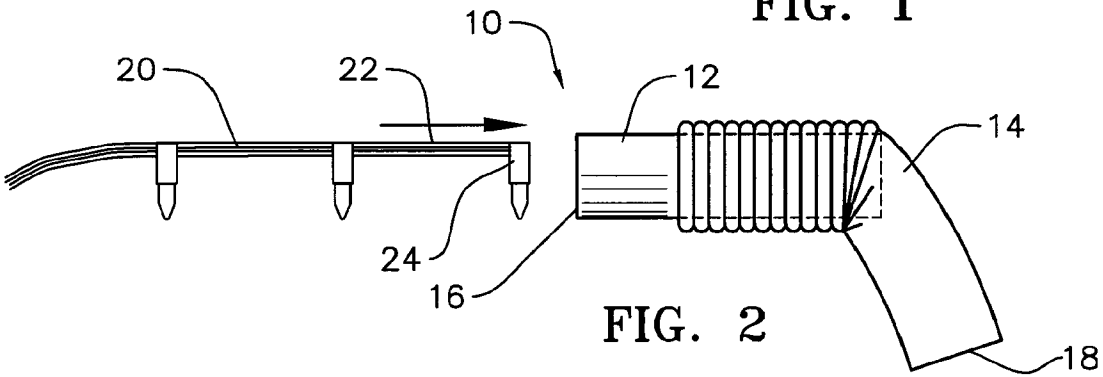
FIG. 2 illustrates the sock and tube of FIG. 1 with the sock bunched up onto the tube ready to receive a light string.
Figure 3:
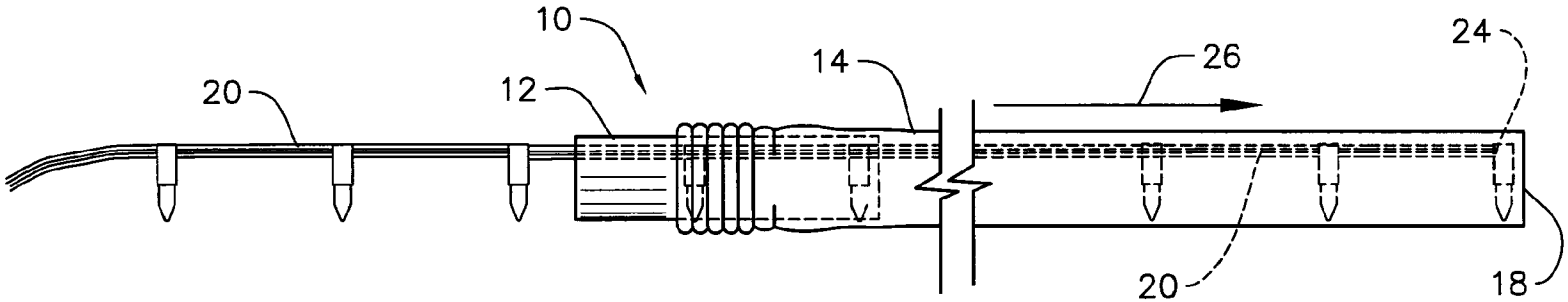
FIG. 3 illustrates the sock and tube of FIG. 2 with the length of the light string being disposed in the length of sock as the light string and sock are pulled together away from the tube.

In the preferred embodiment, the storage device 10 includes a short length of a hollow tube 12 and an elongated sock or sleeve 14. In the preferred embodiment, the tube 12 is made of polyvinylchloride (PVC), but any other material may also be used; it being desirable, however, for the tube 12 to be substantially rigid such that it does not collapse or bend during use as discussed later. In the preferred embodiment, the tube 12 is approximately twelve inches in length and has an internal diameter of approximately two inches. It should be appreciated, however, that the length of the tube 12 may be substantially longer or shorter, depending on the length of the sock 14 to be fed onto the tube as illustrated in FIG. 2 and as discussed later. It should also be appreciated that the tube 12 may be of any suitable diameter, it only being necessary to enable the elongated article 20 (such as light strings or other elongated article) to be able to pass through the tube 12 as illustrated in FIG. 3 and as discussed later. Thus, it should be appreciated that for elongated articles such as icicle lights, or for other lights strings where the lights hang down from the main electrical cord, a larger diameter tube may be required than for a more traditional light string as illustrated in FIGS. 2 and 3 where the light bulb sockets are along the main length of the electrical cord.

In use, as illustrated in FIG. 1, a user grasps one end of the tube 12 with one hand and feeds the open end 16 of the sock 14 onto the opposite end of the tube 12. As illustrated in FIG. 2, the user continues to feed the length of the sock 14 onto the length of the tube 12 until the other end 18 of the sock 14 (preferably a closed end) is in proximity to the tube 12. The light string 20 is then fed into the open end of the tube 12 in the direction as illustrated by arrow 22 until the end 24 of the light string 20 reaches the preferred closed end 18 of the sock 14. With one hand continuing to hold onto the tube 12, the user grasps the sock 14 with the light string 20 disposed therein and pulls the two together away from the tube 12 as illustrated by arrow 26 in FIG. 3. The grasping and pulling action of the sock 14 and light string 20 together continues until the length of the light string 20 passes through the tube 12. Preferably, the length of the sock 14 is the same as or longer than the length of the light string 20 such that the entire length of the light string 20 is completely disposable within the length of the sock 14.

For storage, the sock with the light string disposed therein can be wrapped or coiled around the tube 12 or the sock/light combination can be removed from the end of the tube 12 and coiled and stored separately from the tube 12. It should be appreciated that with the length of the light string 20 disposed within the length of the sock 14, the individual lights comprising the light string 20 are more protected from damage during storage and the individual lights and cord are less likely to become entangled or intertwined. When it is desired to reuse the light string 20, the coiled combination can simply be uncoiled to enable one end of the light string 20 to be pulled from the open end 16 of the sock 14 with or without the tube 12 attached.

In addition to storing light strings, the present invention can be used for storing other elongated articles that have a tendency to become entangled and/or for which a sock or sleeve would provide some protection from damage. For example, the present invention 10 may be used for storing necklaces, bracelets, other jewelry chains and the like. Accordingly, despite the preferred embodiment being described as a storage devices for light strings, the present invention should not be construed as being limited to only a string light storage device.

Although only certain exemplary embodiments of the invention have been described in detail above, those skilled in the art will readily appreciate that many modifications are possible without materially departing from the novel teachings and advantages of this invention. Accordingly, all such modifications are intended to be included within the scope of this invention.

The invention claimed is:

1. A method of storing an elongated article, said method comprising:

with a first hand, grasping a hollow tube having an internal diameter sized to receive the elongated article therethrough, said hollow tube having a first end, a second end and a length, the elongated article having a first end, a second end, and a length;

placing a first open end of an elongated sock over said first end of said hollow tube, wherein said elongated sock has a diameter sized to receive the elongated article and to receive a portion of said length of said hollow tube, said length of said elongated sock being substantially longer than said length of said hollow tube and about as long as or greater than said length of the elongated article;

while continuing to grasp said hollow tube with said first hand, feeding substantially said length of said elongated sock onto said portion of said length of said hollow tube until a second end of said elongated sock is proximate said first end of said hollow tube;

inserting said first end of the elongated article into said second end of said hollow tube and feeding a portion of said length of the elongated article through said hollow tube until said first end of the elongated article extends beyond said first end of said hollow tube and into said elongated sock;

while maintaining the grasp on said hollow tube with said first hand, grasping with a second hand the elongated article extending into said elongated sock beyond said first end of said hollow tube and pulling on the elongated article together with said elongated sock until substantially said length of the elongated article is pulled through the hollow tube and a substantial portion of said length of said elongated sock is removed from said length of said hollow tube, whereby substantially said length of the elongated article is disposed within said length of said elongated sock removed from said hollow tube.

2. The method of claim 1 wherein said elongated article is a light string.

3. The method of claim 1 wherein said elongated article is a necklace.

4. The method of claim 1 wherein said elongated article is a bracelet.

* * * * *